US012384581B2

(12) United States Patent
Ferrari

(10) Patent No.: US 12,384,581 B2
(45) Date of Patent: Aug. 12, 2025

(54) CAROUSEL MACHINE FOR PACKAGING

(71) Applicant: DOLCEPACK SAGL, Villa Luganese (CH)

(72) Inventor: Andrea Ferrari, Villa Luganese (CH)

(73) Assignee: DOLCEPACK SAGL, Villa Luganese (CH)

( * ) Notice: Subject to any disclaimer, the term of this patent is extended or adjusted under 35 U.S.C. 154(b) by 21 days.

(21) Appl. No.: 18/261,381

(22) PCT Filed: Jan. 17, 2022

(86) PCT No.: PCT/IB2022/050350

§ 371 (c)(1),
(2) Date: Jul. 13, 2023

(87) PCT Pub. No.: WO2022/157615

PCT Pub. Date: Jul. 28, 2022

(65) Prior Publication Data

US 2024/0076082 A1 Mar. 7, 2024

(30) Foreign Application Priority Data

Jan. 19, 2021 (IT) ..... 102021000000872

(51) Int. Cl.

| | |
|---|---|
| ***B65B 43/46*** | (2006.01) |
| ***B65B 7/02*** | (2006.01) |
| ***B65B 31/00*** | (2006.01) |
| ***B65B 43/26*** | (2006.01) |
| ***B65B 51/10*** | (2006.01) |
| ***B65B 51/32*** | (2006.01) |
| ***B65B 65/00*** | (2006.01) |

(52) U.S. Cl.
CPC ..... *B65B 43/465* (2013.01); *B65B 7/02* (2013.01); *B65B 31/00* (2013.01); *B65B 43/26* (2013.01); *B65B 51/10* (2013.01); *B65B 51/32* (2013.01); *B65B 65/00* (2013.01)

(58) Field of Classification Search
CPC ..... B65B 43/465; B65B 7/02; B65B 43/26; B65B 43/58; B65B 43/62; B65B 43/50
USPC ..... 53/468
See application file for complete search history.

(56) References Cited

U.S. PATENT DOCUMENTS 2,092,786 A * 9/1937 Taylor ..... B26D 7/0608 99/545
4,115,978 A * 9/1978 Langemeyer ..... B65B 43/12 53/386.1

(Continued)

FOREIGN PATENT DOCUMENTS

EP 0 388 686 B1 12/1993
WO WO 2020/152162 A1 7/2020

*Primary Examiner* — Robert F Long
*Assistant Examiner* — Xavier A Madison
(74) *Attorney, Agent, or Firm* — ASLAN LAW, P.C.

(57) ABSTRACT

A carousel-type packaging machine comprising a plurality of workstations adapted to carry out a sequence of packaging operations and a rotating carousel arranged to move the containers through said workstations, wherein the carousel is arranged with a horizontal rotation axis and includes counter-rotating gripping members adapted to maintain containers in a constant trim during the rotation of the carousel through the various steps of the packaging process; the gripping members are further equipped with movable grippers controlled by motors associated with the workstations.

14 Claims, 6 Drawing Sheets

(56) References Cited

U.S. PATENT DOCUMENTS

| | | | | |
|---|---|---|---|---|
| 4,580,393 | A | 4/1986 | Furukawa | |
| 5,120,292 | A * | 6/1992 | Ueda | B31B 50/322 493/134 |
| 2007/0180794 | A1 * | 8/2007 | Paunesku | B65B 43/04 53/562 |
| 2018/0208407 | A1 * | 7/2018 | Ruge | B65B 35/26 |

* cited by examiner

CAROUSEL MACHINE FOR PACKAGING

CROSS-REFERENCE TO RELATED APPLICATIONS

This application claims priority to IT patent application No. 102021000000872 filed on Jan. 19, 2021, and this application claims priority to and is a 371 of international PCT Application No. PCT/IB2022/050350 filed on Jan. 17, 2022, the entire contents of which are hereby incorporated by reference.

FIELD OF THE INVENTION

The invention relates to the field of carousel-type packaging machines.

PRIOR ART

The so-called carousel packaging machines are distinguished by a rotary member arranged to transport containers through a series of workstations. Typically, each workstation is configured with suitable subsystems to carry out a step of the packaging process, for example opening the container, inserting the product, closing the container.

The rotary member, also termed carousel, is arranged to accommodate a plurality of containers and is controlled to perform intermittent stepwise rotation (indexed rotation). Each rotation step of the carousel leads each of the containers loaded on the carousel to a workstation where a process step is carried out; furthermore, at each step of the carousel, a new empty container can be loaded on the carousel and a filled and closed container can be ejected, for example transferred to a conveyor belt. Packaging machines of this type are well known.

In the machines of the prior art the carousel is generally arranged with a vertical axis of rotation and consequently rotates essentially in a horizontal plane, the workstations being arranged at regular intervals around the wheel.

The applicant has found that this vertical axis arrangement of the carousel has some drawbacks.

Firstly, the vertical axis carousel causes the machine to extend horizontally with the workstations all around the machine, along the path of the carousel.

As a result, each workstation is accessible only from one side of the machine and it is practically impossible for a single operator to have access to all the different workstations. In some cases the presence of two operators around the machine may be required to supervise the operation, which obviously represents an additional cost. For the same reason, acting on the machine to reconfigure the various devices according to the shape or size of the containers is time consuming.

Another drawback is that the mechanical and auxiliary members are grouped under the carousel. This arrangement makes them more difficult to reach and maintenance is more complex. The lower part of the machine, located under the carousel, is difficult to access even for ordinary cleaning and lubrication, thus being exposed to risks of infiltration, product stagnation, oxidation and rust formation. This drawback is felt especially in the food and pharmaceutical sectors where hygiene standards are very high: this forces frequent and expensive maintenance operations.

Still another drawback is given by the considerable size and footprint since the machine extends mainly horizontally around the carousel. In the packaging sector there is a demand for increasingly high production capacities, which implies installing new lines and exploiting as much as possible the available room, therefore the size is an increasingly important aspect.

A further drawback of carousel machines is that the containers, as they rotate with the carousel itself, may change their orientation in the space. This complicates the interaction with stationary devices of the various workstations.

Still another problem is represented by the connections and power supplies for possible mechanical or pneumatic actuation devices mounted on the carousel. In order to achieve maximum efficiency in the process, it is desirable to provide the carousel with movable members, which, however, either require motors mounted on the carousel itself, increasing weight and cost, or adequate power connections between the wheel and the stationary part of the machine. Being the carousel a rotating member, such connections with the outside, be it mechanical or of a different nature, are complex and expensive to make.

In summary, designing a packaging machine of the above-mentioned type poses a series of problems which, in the prior art, have not yet been satisfactorily solved.

SUMMARY OF THE INVENTION

The invention aims to solve the above-mentioned drawbacks of the conventional carousel packaging machines. The invention in particular aims to provide a machine which better suits the modern requirements of the packaging industry. One of the objects of the invention is the provision of a machine with a high productivity and that can be made cost-effectively.

Such an object is achieved by a machine according to the claims.

The invention provides for arranging the carousel with a horizontal axis of rotation. Accordingly, the carousel essentially extends and rotates in a vertical plane. In addition, the gripping members associated with the carousel are counter-rotating in a synchronized manner relative to the carousel itself so as to maintain a constant orientation of the containers.

Thanks to the vertical arrangement of the carousel, the machine extends essentially along the height and all the workstations can be arranged to be easily accessible from a front side of the machine (facing the operator). Thus, a single operator can supervise the machine operation and the packaging process.

The horizontal axis carousel allows to design the machine with a front side where the workstations are mounted and a rear side (back of the machine) where the mechanical and auxiliary components are grouped. Such arrangement greatly facilitates access to components for cleaning and maintenance. The machine is thus adapted to meet stringent hygiene requirements, such as those prescribed in the food and pharmaceutical sectors.

It is also more convenient to intervene on the machine for configuration according to the containers to be handled. This is a remarkable advantage since packaging machines are also required to be highly flexible and capable of operating with containers of different shapes and/or types, and the invention reduces downtime for such preparation.

In addition, the footprint of the machine is reduced as it extends vertically. Compared to a conventional machine, the footprint may be reduced by about 50%.

The constant orientation of the containers, which is made possible by the synchronized counter-rotation of the gripping members, facilitates interaction with the stationary devices of the machine. The packaging process is more precise and controllable.

A machine according to the invention can be configured for packaging in rigid containers such as jars or bottles, or flexible containers such as bags or pouches. The field of packaging in flexible containers represents a particularly interesting application. The product may be in solid, granular, powder, or liquid form.

The invention substantially innovates the design of packaging machines of the type considered herein.

A packaging process according to the attached claims is also an object of the invention.

DESCRIPTION OF PREFERRED EMBODIMENTS

The gripping members are preferably configured to maintain the containers in a vertical orientation. Preferably, the containers are maintained in a vertical position with an upward-facing opening, so that the product can be introduced into the containers from above, for example by gravity through a funnel.

Each of the gripping members mounted on the carousel preferably comprises a longitudinally extended body or frame.

In a preferred embodiment, the carousel comprises a plurality of radial arms, wherein each of said arms bears one of the gripping members. More preferably, each of the gripping members has a body which is hinged to a respective arm of the carousel and is connected to a transmission adapted to impart to the body the said counter-rotation as synchronized with respect to the advancement of the carousel. Said transmission is preferably belt-driven, which is suitable for a connection between the centre and periphery of the carousel.

The carousel can include a single wheel with cantilever-mounted gripping members. An implementation with two wheels placed side by side and gripping parts mounted between the two wheels is also possible, i.e. with the ends hinged respectively to the one and the other of the two wheels.

In addition, each gripping member can comprise two or more gripper devices arranged to grab one side of one of the containers. For example, said gripper devices can be configured to clamp an edge or a side of a flexible bag or pouch.

Preferably said gripper devices are made with pneumatically or mechanically actuated grippers.

At least one of the two gripper devices may be sliding along the body thus being able to vary the gripping distance between said two devices.

The gripping member can be equipped with a transmission system which is operable from outside the gripping member and is arranged to move said at least one sliding gripper device. Advantageously, at least one of the workstations comprises a motor that can be temporarily coupled to the transmission system when the gripping member is in the workstation.

The gripping member may be configured to receive a single container or multiple containers, for example two containers.

In one embodiment, each gripping member bears two sliding gripper devices arranged to hold a container, preferably a bag or pouch, by clamping the opposite sides thereof. In this case, the transmission system mounted on each gripping member is preferably configured to simultaneously move the two gripper devices with a mutually approaching or distancing movement. The simultaneous control of the two gripper devices allows a precise control when handling the container or containers.

In another embodiment, each gripping member is equipped with three gripper devices arranged to hold two containers. In this case, the three gripper devices are aligned along the gripping member; each of said two containers is held by the central gripper device and one of the two lateral gripper devices. The lateral gripper devices are preferably sliding.

The provision of at least one movable gripper device mounted on board the gripping members gives an additional degree of flexibility in handling the containers. In the case of flexible containers, which represent a preferred application, the presence of at least one movable gripper device for example allows the gripping member to actively operate to open or close the pouch itself.

A significant advantage of the solution described above (with a gripping member transmission system that can be coupled to an external motor) is that the motor is associated with the workstation and does not have to be mounted on board the gripping member, i.e. on the rotating carousel. This reduces the mass of the carousel and avoids rotating connections to power the motor. In addition, it is possible to motorize only the workstations required to actively operate the gripping member, for example to open or close a pouch, rather than mounting a motor for each gripping member.

Said temporary coupling between the motor and the transmission system is preferably of the contactless type. A preferred embodiment provides a magnetic coupling. A contactless coupling is preferred as motion must be transferred to a movable member like the carousel.

In more detail, in a preferred embodiment, a flange of the motor and a flange of the transmission system are brought into a condition of contactless magnetic coupling when the gripping member is in the workstation. The motor itself can be movable (e.g. on a suitable trolley) between a waiting position and a position of coupling with the transmission system, so that when the gripping member reaches the workstation, the motor moves to the coupling position and the drive flange approaches the driven flange so that torque is magnetically transferred between the two flanges.

A sliding gripper device can be made by mounting the device itself on a slide. Said slide is preferably actuated by a shaft of the transmission system through a coupling adapted to transform a rotation into a translation. For this purpose, a particularly preferred coupling is of the ball bearing type because of its precision.

A particularly preferred embodiment provides a gripping member which supports, on suitable guides, two sliding slides; each slide bears a respective gripping member with a gripper; the body has in a central position a flange for interface with an external motor; said flange is fixed to a gear transmission driving two shafts, each engages a respective slide with a ball bearing coupling. In addition, the body of the gripping member is hinged to the carousel and is connected to a transmission, preferably a belt transmission, which provides the described counter-rotation to maintain the constant trim of the container.

The workstations can be configured, for example, to perform operations of: receiving containers, opening containers, introducing a product, closing containers and ejecting them. The containers may be received from a first conveyor system, such as a conveyor belt, and similarly the filled and closed containers may be ejected to a second conveyor system.

The workstations are arranged according to the sequence of steps in the packaging process, along a circular trajectory determined by the carousel.

The packaging process can provide the supply of a gas such as air, nitrogen, carbon dioxide into the containers prior to the product. In the case of flexible containers, supplying a gas can help open the container before introducing the product. A non-oxidant inert gas is advantageous in packaging perishable products such as food products.

In more detail, when flexible containers are used, the stations preferably comprise, in the order: a first station for receiving the containers; a second station for opening the containers; optionally a third station for expanding the containers, possibly with the introduction of a gas; a fourth station for inserting a product into the containers; a fifth station for sealing the containers; a sixth station for ejecting the sealed containers. Preferably, the station for opening and the station for introducing the product are motor-driven as described above.

The sealing station can be configured, for example, to perform a welding of the flexible containers. Preferably, such welding is carried out with a heat input to locally melt the material along a predetermined welding line. A following workstation can be configured to cool the weld so as to ensure complete solidification of the material before ejecting the containers. Said workstation can comprise for this purpose suitable cooled surfaces, for example two cooled plates that are brought into contact with the container along the welding line.

In a preferred embodiment, for example, said station comprises a cooled jaw mounted on a rotatable arm about a horizontal axis; the cooled jaw closes on the edge of the pouch where the weld was made and the bag is released from the wheel gripping member; with a rotation of the rotatable arm, said jaw brings the pouch to the ejection position and meanwhile the weld is strengthened by the cooling action. Advantageously, the cooled jaw is articulated so as to keep the pouch always vertical even during the described discharge/ejection movement.

A packaging process that can be carried out with a machine according to the invention, with particular reference to flexible containers, can comprise the following operations:

- each of the flexible containers, in a vertical position, is gripped by one of the gripping members of the carousel along the right and left sides, by two respective gripper devices;
- in correspondence with a first motorized station, the gripper devices are controlled to move closer for spreading apart a top opening of the container promoting the introduction of an expansion gas and/or the insertion of the product;
- in correspondence with a second motorised station, after introducing the product, the gripper devices are controlled to move away so as to close the container and prepare it for welding so as to close the aforementioned top opening.

In a preferred embodiment, all the workstations face a same front side of the machine for ease of access, maintenance and adjustment operations. Preferably, the machine comprises a front side where the workstations are located and a rear side, opposite to said front side, where mechanical members and auxiliary devices are grouped. The rear of the machine can comprise, for example, a box for housing the auxiliaries and said box can be manufactured with the degree of protection against the penetration of liquids and dust required by the customer (e.g. IP 54 or IP 65).

Figure 1:
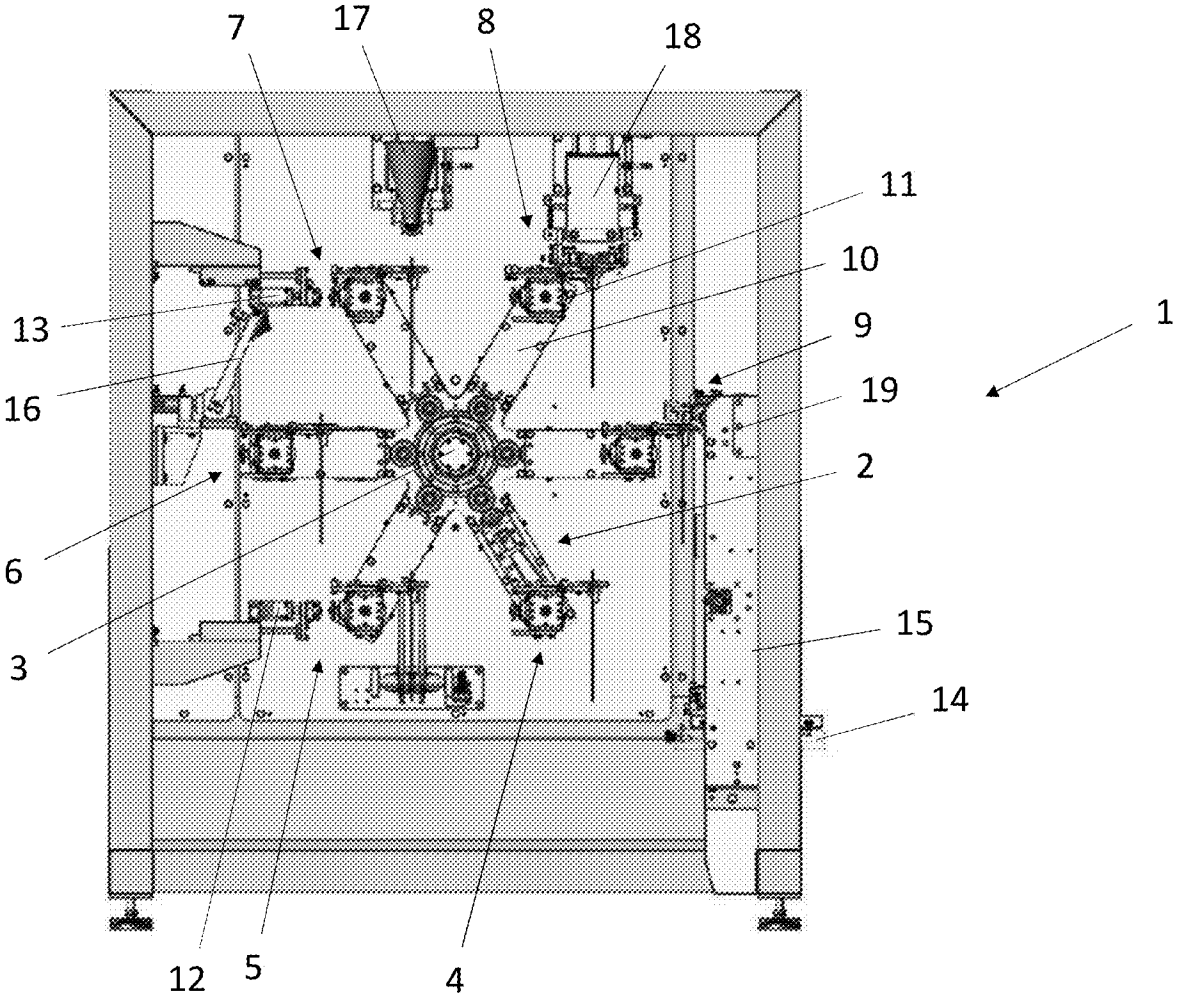
FIG. 1 schematically shows a packaging machine according to an embodiment of the invention.

The figures essentially illustrate the following details:

1 packaging machine
2 rotating carousel
3 rotation fulcrum of the carousel 2
4-9 workstations of the machine 1
10 radial arms of the carousel 2
11 grippers mounted on the carousel 2
12, 13 motors for actuating the movable members of the grippers 11
14 conveyor
15 member for picking up pouches from the conveyor 14
16 gas insufflation device
17 product inserter
18 pouch welding and sealing device
19 weld cooling device and pouch ejection device
20 gripper body
20*a*, 20*b* gripper body ends
21 gripper bearing
22 belt transmission for opposite rotation of the gripper 11
220 gear wheel of a transmission 22
221 ring gear on which the wheels mesh 220
23*a*, 23*b* sliding slides mounted on the gripper body 20
24 slide guides 23*a*, 23*b*
25*a*, 25*b* pneumatic clamping grippers mounted on the slides 23*a*, 23*b*
26 transmission box for slide control 23*a*, 23*b*
27 motor flange for controlling sliding slides
29*a*, 29*b* shafts for controlling slides 23*a*, 23*b*
30 motor drive flange 12 or 13 adapted to engage the flange 27
31 top opening of a pouch S
32 motor positioning system The packaging machine 1 comprises a carousel 2 with a horizontal rotation axis determined by a fulcrum 3 and a number of workstations 4-9. In the example, the machine 1 is designed to package a loose product, for example in solid or granular form, inside flexible pouches S which can be made of plastic or paper material with a plastic sealing base. Each of the workstations 4-9 is configured to carry out a process step by suitable sub-systems.

The carousel 2 is essentially star-shaped and comprises radial arms 10 each bearing a gripping member represented by a gripper 11. The grippers 11 in the embodiment of FIG. 1 are each configured to grab a pouch S.

The carousel 2 is controlled to perform indexed rotations, for example of 60 degrees. As is apparent from the figure, the intermittent rotation of the carousel 2 progressively conveys each pouch (being grabbed in one of the grippers 11) through stations 4-9. Thus, each pouch S is sequentially subjected to the working steps provided by the packaging process.

The machine further comprises two motors 12 and 13 associated with stations 5 and 7 respectively. Said motors are capable of actuating suitable movable members of the grippers 11 as will be explained in more detail hereinafter.

More precisely the station 4 is adapted to pick up a pouch from a conveyor 14, by means of a suitable pick-up system 15 and deliver it to one of the grippers 11. For this purpose, the system 15 can be equipped with a suitable suction cup member capable of picking up the pouch and, still keeping it in a vertical position, delivering it to one of the grippers 11.

Figure 7:
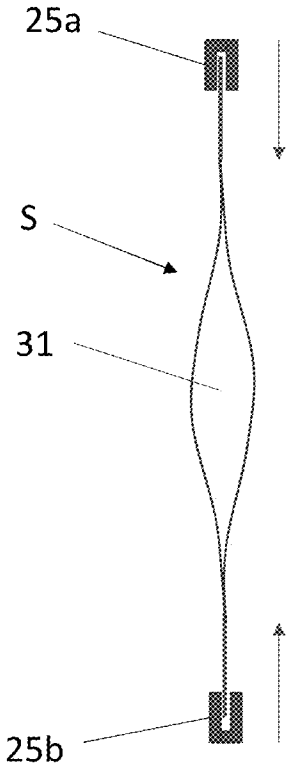
FIG. 7 schematically illustrates the opening of a pouch by means of the movable devices of one of the gripping members.

The station 5 is adapted to carry out an operation for opening the pouch with the aid of the motor 12 by acting on movable members of the gripper 11 (FIG. 7).

The station 6 is adapted to carry out an operation for expanding the pouch and introducing a gas such as air or an inert gas, by means of a gas insufflation device 16, in order to prepare the pouch for the product introduction step.

The station 7 introduces a desired amount of product into the pouch by means of a product inserter 17 for example configured as a hopper or funnel. In addition, the station 7 is equipped with the motor 13 to stretch the pouch, after introducing the product, preparing it for the following sealing step.

The station 8 in the illustrated embodiment seals the pouch by welding the plastic material or, in another embodiment, seals the container by applying a cap.

The station 9 cools the weld by means of the device 19 to ensure sealing and delivers the filled and closed pouch to an outlet conveyor.

The described stations and the respective components may be made with a technique known to an expert in the field and therefore do not require a more detailed description.

FIG. 1 is a side view that makes it possible to appreciate the vertical extension of the machine 1. The workstations 4-9 are all located in positions that are easily accessible from the front side of the machine.

Figure 2:
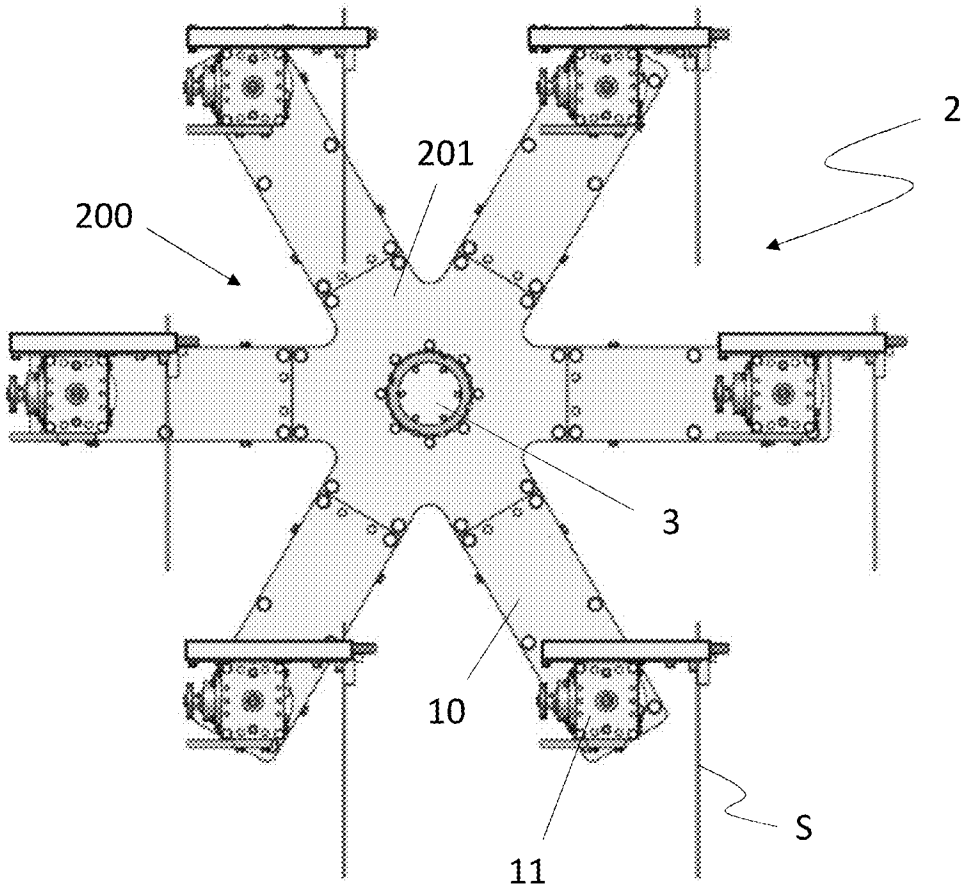
FIG. 2 is a scheme of the carousel of the machine of FIG. 1.
Figure 4:
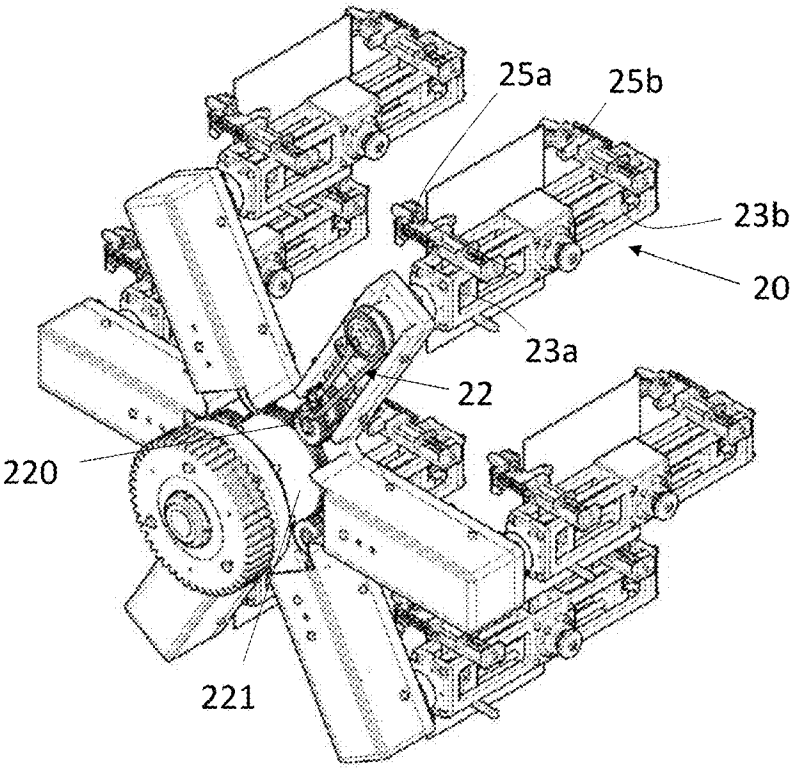
FIG. 4 is a rear view of the carousel.
Figure 3:
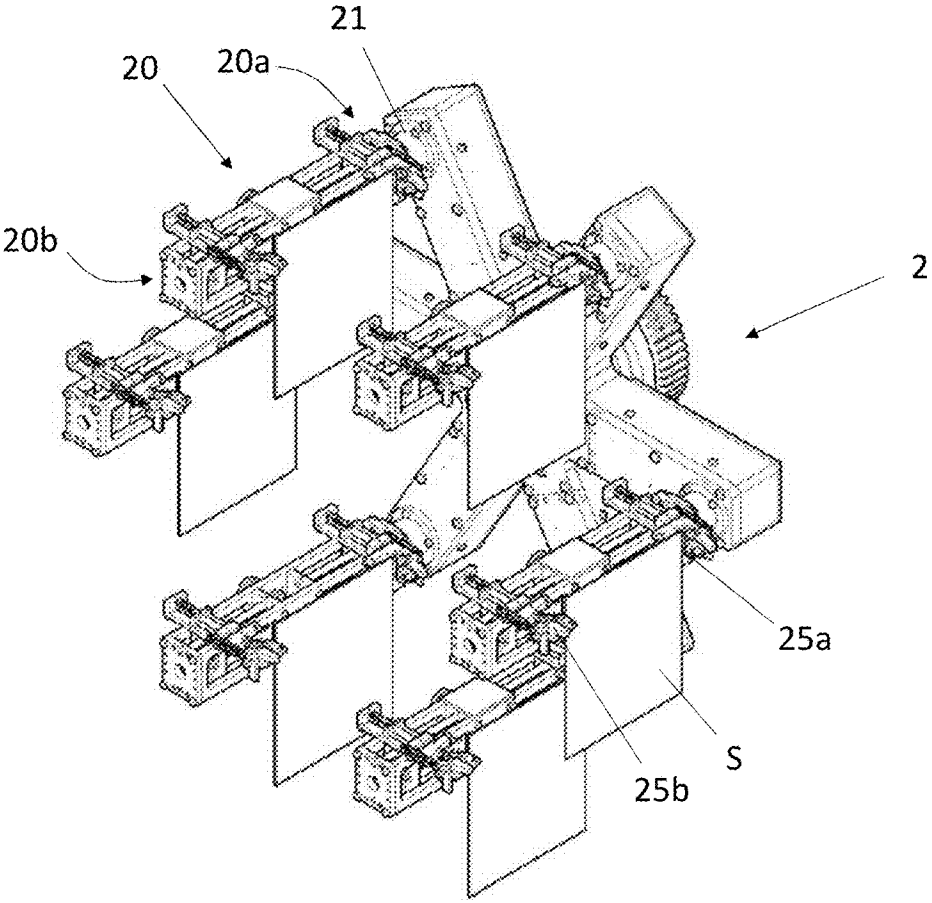
FIG. 3 is a front view of the carousel of the machine of FIG. 1.
Figure 5:
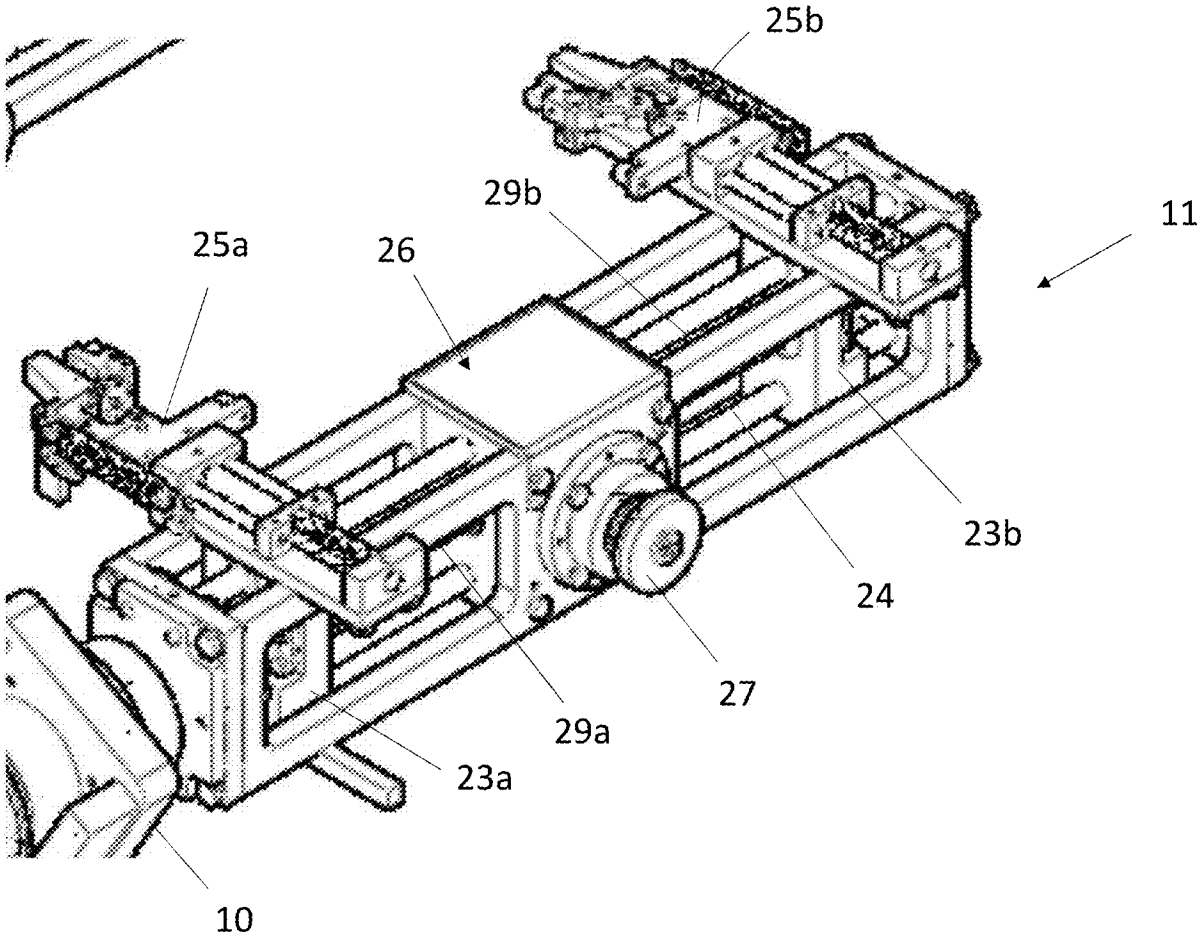
FIG. 5 shows the detail of one of the gripping members of the carousel.

FIG. 2 schematically shows the carousel 2 and highlights how the grippers 11 keep the pouches S in a constant vertical trim as the carousel rotates. This facilitates interaction with the above-described workstation systems 4-9. FIG. 2 shows an example in which the carousel 2 includes a wheel or star 200 having a central body 201 that is attached to the rotation pin 3 and from which the described plurality of arms 10 branch off.

In order to maintain the constant orientation of the containers (vertical in the example of FIG. 2) each of the grippers 11 is rotatable relative to its own arm 10 and is connected to a transmission system that imparts a rotation of the gripper 11 relative to the arm 10 that is equal and opposite to the rotation of the carousel about the fulcrum 3. It derives that the rotation of the carousel 2 is compensated by the concurrent opposite rotation of the grippers 11 which substantially follow a circular trajectory while maintaining a constant orientation in space.

FIGS. 3-6 allow to appreciate further details of an exemplary embodiment.

Each of the grippers 11 substantially comprises a gripper body 20 hinged at the end of an arm 10 by means of at least one bearing 21. A belt transmission system 22 (FIG. 4) imparts to the gripper body 20 the compensation counter-rotation of the above-described trim.

The gripper body 20, in the illustrated embodiment, extends essentially cantilevered from the arm 10. In another embodiment (not shown), the gripper body can be hinged on both sides between two wheels placed side by side. More specifically, referring to FIG. 3, in the embodiment illustrated, the gripper body 20 has a proximal end 20*a* hinged to the wheel 200; in a dual-wheel variant, the opposite end 20*b* may also be hinged to another wheel (not shown).

The belt transmission 22, in other embodiments, can be replaced with a shaft and gear transmission or another equivalent one.

All the transmission systems 22 of the various grippers 11 are controlled simultaneously. For this purpose, each of the transmissions 22 is driven by a gear wheel 220, and all the gear wheels 220 mesh a ring gear 221.

The gripper body 20 bears two slides 23*a*, 23*b* sliding on guides 24. Each of the slides 23*a*, 23*b* in turn bears a gripper clamping member, such as mechanical or pneumatic 25*a*, 25*b*. Said pneumatic grippers 25*a*, 25*b* are arranged to press a container on both sides, for example to grab the sides of a bag or pouch. As it can be seen in the figure, the pneumatic grippers are advantageously mounted on a spacer plate.

The sliding of both slides 23*a*, 23*b* is controlled simultaneously by a transmission housed inside the box 26 and connected to a flange 27. Said flange 27 is preferably placed in a central and rear position of the gripper 11, i.e., opposite the front side of the gripper where the container is grabbed.

Said transmission actuates, for each slide, a shaft 29*a*, 29*b*; the latter by means of a ball bearing coupling (or equivalent capable of transforming a rotary motion into a translatory motion) imparts to the slide 23*a* or 23*b* the desired linear displacement.

Advantageously the transmission is configured so that the shafts 29*a* and 29*b* of the two slides have an opposite rotation direction, so that by imparting a rotation to the flange 27, the two slides 23*a*, 23*b* (and the gripper devices 25*a*, 25*b*) move in an opposite direction mutually approaching or distancing.

The flange 27 can be driven by the motor 12 or motor 13 when the gripper is in the corresponding workstation. For this purpose, the motor 12 (and similarly the motor 13) has a driving flange 30 capable of engaging the flange 27 without contact (for example magnetically). The motor can be mounted on a suitable carriage or movable support 32 to approach it to the gripper 11 so that the flange 30 is facing and is sufficiently close to the driven flange 27 (FIG. 6).

Figure 6:
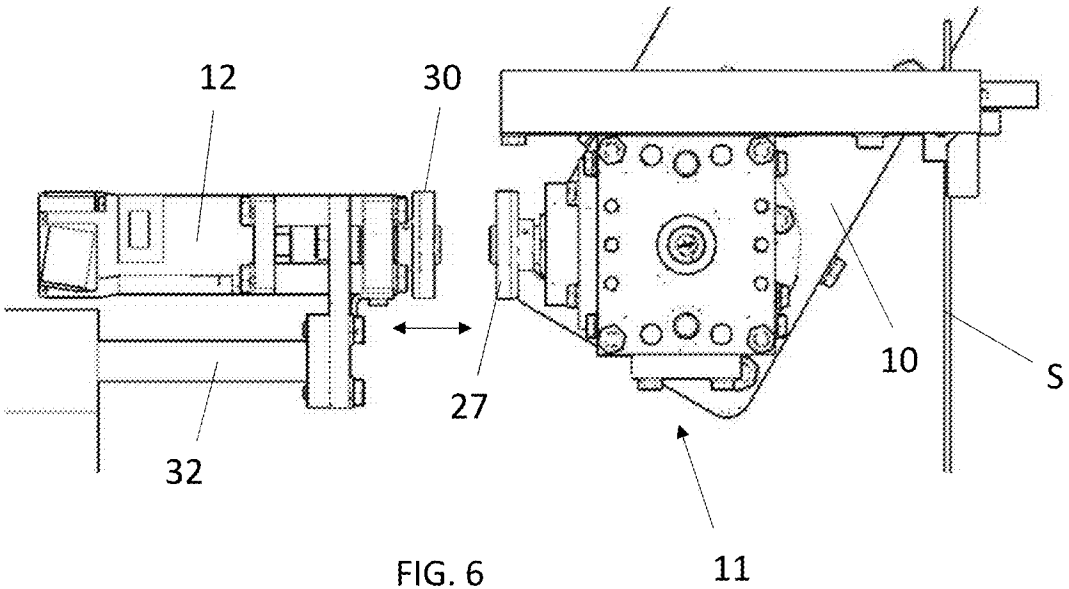
FIG. 6 illustrates the actuation of the movable devices of a gripping member by means of an external motor.

The motor-flange unit is movable in the direction of the double arrow of FIG. 6 approaching the drive flange 30 to a close distance to allow contactless actuation. In a variant, a mechanical engagement with contact between the flanges 30 and 27 can be provided. The machine comprises a control system overviewing all the various functions, in particular indexed rotation of the carousel, actuation of the various systems present in the workstations, control of the motors 12 and 13 for distancing or approaching the grippers 25*a*, 25*b* according to the packaging process step.

FIG. 7 exemplifies the principle based on which the movable members of the gripper 11 may open a pouch S or stretch it. The figure shows a bag or pouch S held on its sidewalls by the two pneumatic grippers 25*a*, 25*b*. An approach movement of the grippers, impressed by the motor 12 or 13 in engagement relation with the flange 27 of the gripper 11, allows the upper opening 31 of the pouch to be enlarged, facilitating the introduction of the product. Similarly, the distancing movement of the grippers stretches the pouch, preparing it for welding.

Figure 8:
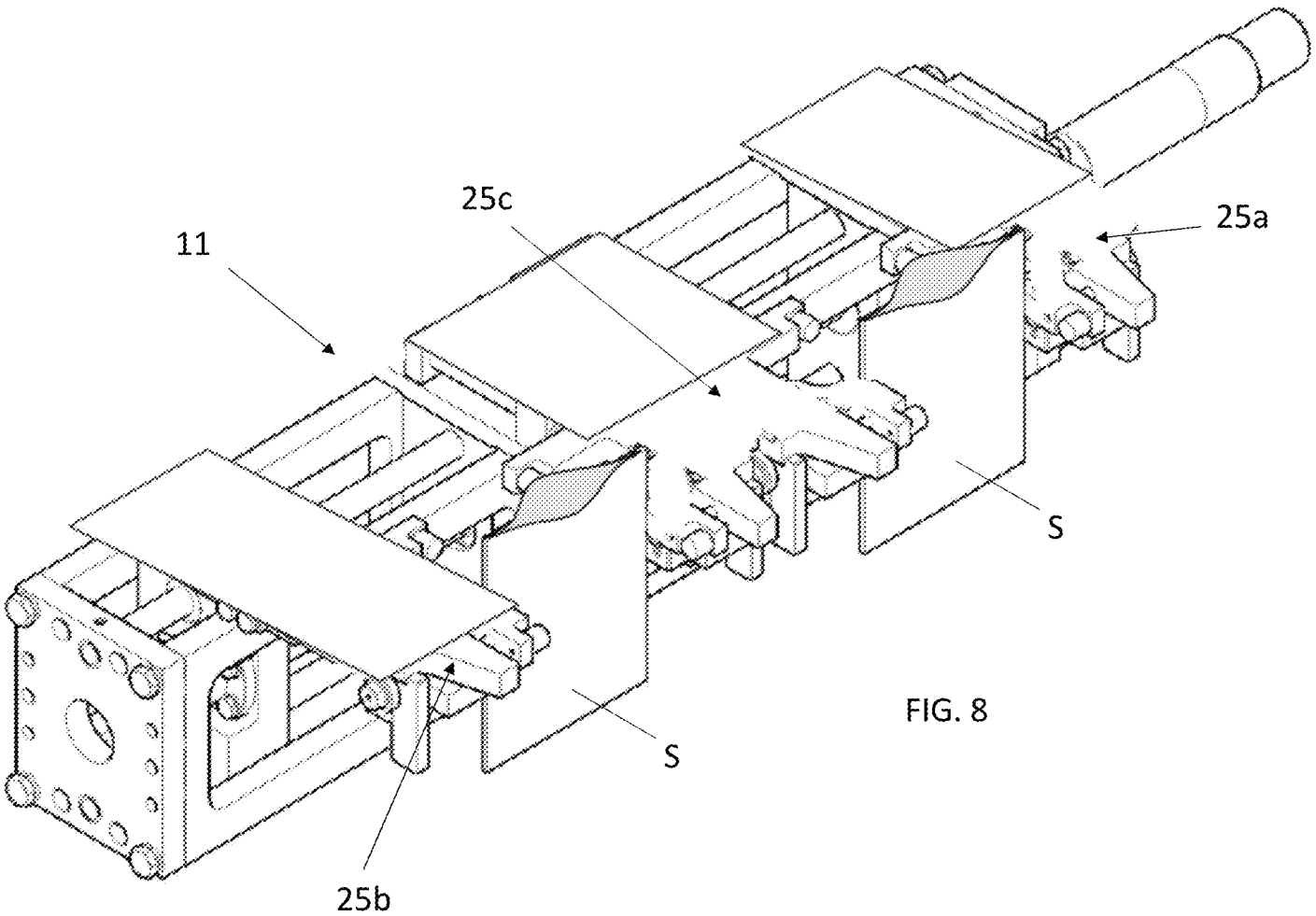
FIG. 8 illustrates a variant of a gripping member.

FIG. 8 shows an embodiment wherein the gripper 11 is equipped with a third pneumatic gripper 25*c* in a central position between the two grippers 25*a* and 25*b*. Advantageously, the central gripper 25*c* is fixed while the side grippers 25*a* and 25*b* are sliding as described above. Note that the central gripper 25*c* is a "double" gripper designed to be able to grab one side of a pouch at both sides.

Thus configured, the gripper 11 is capable of carrying two pouches S as shown in the figure, each of the two pouches being held on an inner sidewall by the central gripper 25*c*, and on an outer sidewall by the gripper 25*a* or 25*b*.

The invention claimed is:

1. A machine for packaging one or more products into containers, said machine comprising:

a plurality of workstations adapted to carry out a sequence of packaging steps and an intermittent-rotation carousel which includes a plurality of gripping members for said containers and is arranged to position the containers in sequence through said workstations, wherein said carousel is arranged with a horizontal axis of rotation and the gripping members are counter-rotating in a synchronous manner relative to the carousel for maintaining a constant orientation of the containers in a vertical position, and wherein the carousel includes a plurality of radially arranged arms, each of said arms bearing one of said gripping members, and wherein each of the gripping members has a body which is hinged to a respective arm of the carousel and is connected to a transmission, wherein said transmission is configured to rotate the body relative to the arm, said rotation of the body being opposite and synchronised with respect to the rotation of the carousel about the axis of the carousel, and wherein each of the gripping members includes at least two gripper devices; each of said devices is adapted to grab a portion or a side of one of the containers; at least one of said two gripper devices is slidable along the body of the gripping member thus varying the distance between said sliding gripper device and at least another gripper device of the gripping member; each gripping member includes a transmission system operable from outside the gripping member and adapted to move said at least one sliding gripper device, and wherein at least one of the workstations includes a motor which can be temporarily coupled to the transmission system of each gripping member when the gripping member is in the workstation equipped with said motor, allowing the motor to control the sliding device or devices.

2. The machine according to claim 1, wherein each gripping member includes two gripper devices arranged to slide with respect to the body of the gripping member and the transmission system mounted on each gripping member is configured to simultaneously move the two gripper devices with a mutually approaching or distancing movement.

3. The machine according to claim 2, wherein:

each gripping member includes two gripper devices sliding and arranged to grab a container along opposite sides thereof, or each gripping member comprises three gripper devices, including two lateral sliding devices and a central device in a fixed position, said devices being arranged to carry two containers, so that each of the containers has a side or a sidewall grabbed by the central gripper device, and an opposite side grabbed by one of the lateral devices.

4. The machine according to claim 3, wherein at least one of the workstations includes a motor which can be temporarily coupled to the transmission system of each gripping member when the gripping member is in the workstation equipped with said motor, allowing the motor to control the sliding device or devices.

5. The machine according to claim 4, wherein the temporary coupling between the motor of the workstation and the transmission system of the gripping member is a contactless coupling.

6. The machine according to claim 5, wherein said machine is configured to operate with flexible containers and wherein the workstations comprise at least one station for opening the containers and one station for introducing a product and closing the containers, and said two workstations each comprise a respective motor for actuating the transmission system of the gripping member.

7. The machine according to claim 6, said machine further comprising: a station for expanding containers which is configured to introduce a gas into the containers, preferably air, nitrogen or carbon dioxide, before introducing the product; a sealing station which is configured to weld the containers with supply of heat, along a predetermined welding line; a station configured to cool the weld before ejecting the containers.

8. The machine according to claim 7, wherein all workstations are facing a same front side of the machine.

9. A process for packaging a product into containers, carried out in a machine according to claim 8, said process comprising the transport of the containers through the workstations along a circular trajectory contained in a vertical plane, due to the intermittent rotation of the carousel, wherein the containers loaded on the carousel keep a constant trim, preferably vertical, during the process.

10. The process according to claim 9 wherein the containers are flexible and the process comprises the operations of opening containers, expanding the containers, introducing a product, closing and sealing, and wherein:

each of the flexible containers, in a vertical position, is grabbed by one of the gripping members of the carousel along the right and left sides, by two respective gripper devices, the process comprises steps of moving the movable gripper devices mounted on the gripping members, to respectively approach the edges and open the container to facilitate the introduction of the product, and to stretch the container and allow closure thereof;

the movement of said gripper devices being actuated, in the respective workstations, by a motor mounted outside the rotating carousel and by a temporarily coupling of said motor with a transmission system mounted on board of the gripping member.

11. The machine according to claim 2, wherein at least one of the workstations includes a motor which can be temporarily coupled to the transmission system of each gripping member when the gripping member is in the workstation equipped with said motor, allowing the motor to control the sliding device or devices.

12. The machine according to claim 5, wherein said contactless coupling is of the magnetic type.

13. The machine according to claim 5, said machine further comprising: a station for expanding containers which is configured to introduce a gas into the containers, preferably air, nitrogen or carbon dioxide, before introducing the product; a sealing station which is configured to weld the containers with supply of heat, along a predetermined welding line; a station configured to cool the weld before ejecting the containers.

14. The machine according to claim 1, wherein said machine is configured to operate with flexible containers and wherein the workstations comprise at least one station for opening the containers and one station for introducing a product and closing the containers, and said two workstations each comprise a respective motor for actuating the transmission system of the gripping member.

* * * * *